US010204728B2

(12) United States Patent
Hwang et al.

(10) Patent No.: US 10,204,728 B2
(45) Date of Patent: Feb. 12, 2019

(54) VARIABLE INDUCTANCE INDUCTOR AND VARIABLE INDUCTANCE INDUCTOR MODULE

(71) Applicant: SAMSUNG ELECTRO-MECHANICS CO., LTD., Suwon-si (KR)

(72) Inventors: Mi Ran Hwang, Suwon-si (KR); Seong Jong Cheon, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 145 days.

(21) Appl. No.: 15/010,008

(22) Filed: Jan. 29, 2016

(65) Prior Publication Data

US 2016/0372247 A1 Dec. 22, 2016

(30) Foreign Application Priority Data

Jun. 16, 2015 (KR) ..... 10-2015-0085068

(51) Int. Cl.
*H01F 21/04* (2006.01)

(52) U.S. Cl.
CPC ..... *H01F 21/04* (2013.01)

(58) Field of Classification Search
CPC ..... H01F 21/12; H01F 21/005; H01F 27/004; H01F 29/06; H01F 29/025
USPC ..... 336/137–144, 149–150
See application file for complete search history.

(56) References Cited

U.S. PATENT DOCUMENTS

| | | | | |
|---|---|---|---|---|
| 2,568,310 | A * | 9/1951 | Whiffen | H01F 21/06 29/605 |
| 6,573,638 | B1 * | 6/2003 | Yamamoto | H01L 41/107 310/359 |
| 2003/0137222 | A1 * | 7/2003 | Takeda | H01L 41/107 310/359 |
| 2004/0090298 | A1 * | 5/2004 | Masu | H01F 17/0006 336/200 |
| 2008/0007384 | A1 * | 1/2008 | Yan | H01F 17/0006 336/206 |
| 2008/0129434 | A1 * | 6/2008 | Khajehpour | H01F 21/12 336/139 |
| 2009/0174014 | A1 * | 7/2009 | Kunze | B81B 3/0024 257/415 |
| 2011/0018668 | A1 * | 1/2011 | Imbimbo | H01F 21/005 336/136 |
| 2011/0227456 | A1 * | 9/2011 | Horiguchi | B60C 23/0411 310/339 |

FOREIGN PATENT DOCUMENTS

| | | | | |
|---|---|---|---|---|
| GB | 1219459 | A * | 1/1971 | H01F 21/12 |
| JP | 05159938 | A * | 6/1993 | |
| JP | 8-288143 | A | 11/1996 | |
| JP | 10163031 | A * | 6/1998 | |
| KR | 10-2004-0024467 | A | 3/2004 | |

* cited by examiner

*Primary Examiner* — Tsz Chan
(74) *Attorney, Agent, or Firm* — NSIP Law

(57) ABSTRACT

A variable inductance inductor includes an inductor unit having a coil pattern; and at least one inductance controlling unit configured to vary a contact area between the coil pattern and a moveable conductor unit to change a current path.

17 Claims, 6 Drawing Sheets

VARIABLE INDUCTANCE INDUCTOR AND VARIABLE INDUCTANCE INDUCTOR MODULE

CROSS-REFERENCE TO RELATED APPLICATION

This application claims the benefit under 35 USC 119(a) of Korean Patent Application No. 10-2015-0085068 filed on Jun. 16, 2015, with the Korean Intellectual Property Office, the entire disclosure of which is incorporated herein by reference for all purposes.

BACKGROUND

1. Field

The following description relates to a variable inductance inductor and a variable inductance inductor module.

2. Description of Related Art

Inductance refers to property of an electrical conductor in which a flow of current may be disturbed by a change in a magnetic field created in or around a coil. Inductance may be increased as a frequency of a voltage flowing in a coil pattern and a length of the coil pattern is increased. An element that implements the above-mentioned inductance is referred to as an inductor, manufactured and used as a wound inductor, a stack-based inductor, or a thin film-based inductor depending on an application thereof.

However, because a typical inductor has fixed inductance, it may have a disadvantage in that it is impossible to reversibly adjust desired inductance other than by using a method for exchanging the inductor itself when the inductor is used to match electronic elements. To solve the above-mentioned disadvantage, research into implementing a variable inductance inductor has recently been undertaken

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a variable inductance inductor includes an inductor unit having a coil pattern; and at least one inductance controlling unit configured to vary a contact area between the coil pattern and a moveable conductor unit to change a current path. An inductance value varies according to the contact area. A piezoelectric material disposed on the support member actuates the moveable conductor unit.

In another general aspect, a variable inductance inductor module includes an insulating module; an inductor unit having a coil pattern; an inductance controlling unit having a movable conductor unit; and a driving unit configured to apply an external driving force to the inductance controlling unit to vary an inductance value and adjust a contact area between the coil pattern and the conductor unit to change a current path.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
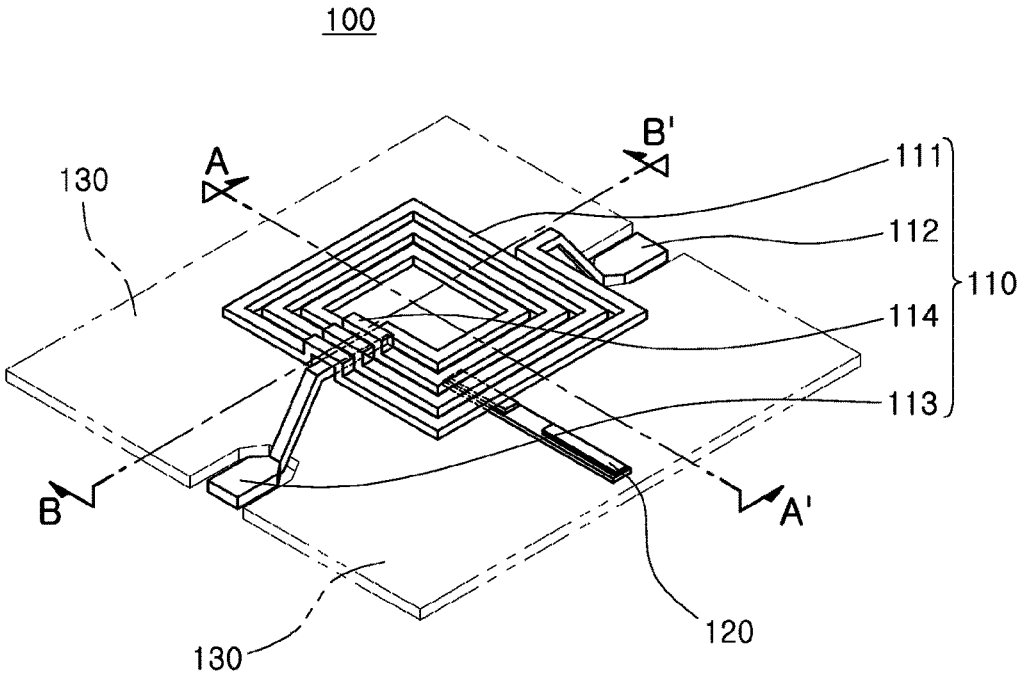
FIG. 1 is a perspective view schematically illustrating a variable inductance inductor according to one or more embodiments.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. It will be apparent that though the terms first, second, third, etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the embodiments.

Unless indicated otherwise, a statement that a first layer is "on" a second layer or a substrate is to be interpreted as covering both a case where the first layer directly contacts the second layer or the substrate, and a case where one or more other layers are disposed between the first layer and the second layer or the substrate.

Words describing relative spatial relationships, such as "below", "beneath", "under", "lower", "bottom", "above", "over", "upper", "top", "left", and "right", may be used to conveniently describe spatial relationships of one device or elements with other devices or elements. Such words are to be interpreted as encompassing a device oriented as illustrated in the drawings, and in other orientations in use or operation. For example, an example in which a device includes a second layer disposed above a first layer based on the orientation of the device illustrated in the drawings also encompasses the device when the device is flipped upside down in use or operation.

The terminology used herein is for describing particular embodiments only and is not intended to be limiting of the following description. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Figure 2:
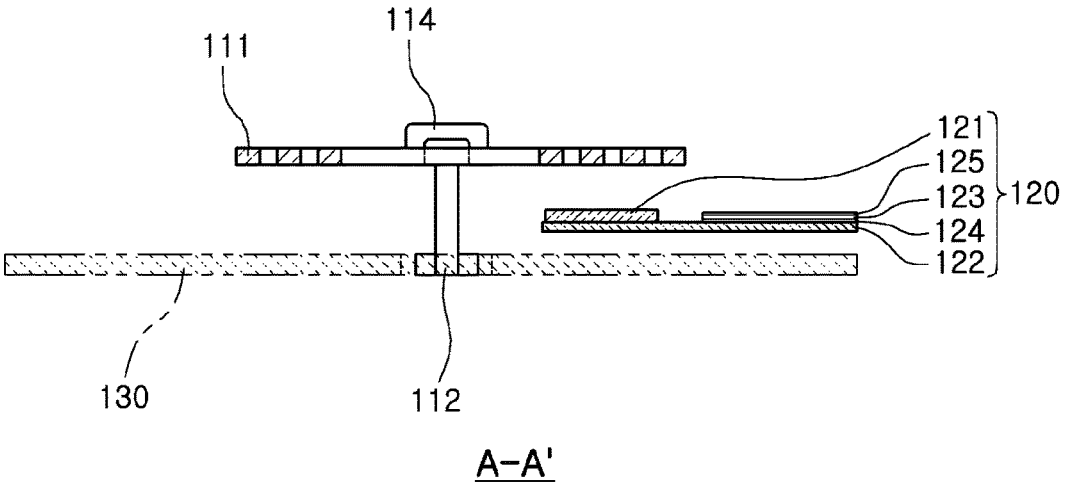
FIG. 2 is a cross-sectional view taken along line A-A' of FIG. 1.
Figure 3:
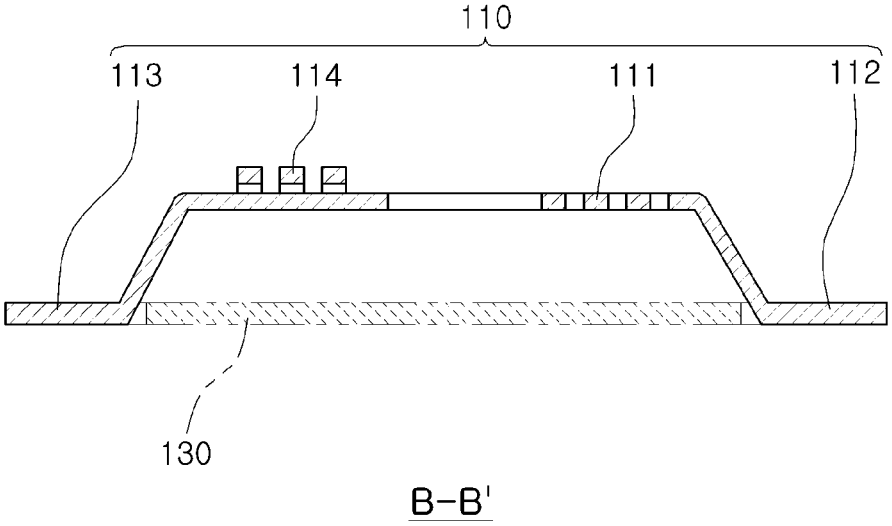
FIG. 3 is a cross-sectional view taken along line B-B' of FIG. 1.

Referring to FIGS. 1 through 3, a variable inductance inductor 100 according to one or more embodiments includes an inductor unit 110 including a coil pattern 111 and an inductance controlling unit 120 including a conductor unit 121.

Only one inductance controlling unit 120 is illustrated in FIGS. 1 through 3, but the number of inductance controlling units 120 is not limited thereto. For example, an inductance value may be controlled using two or more inductance controlling units 120. In this case, the inductance value may be more precisely controlled with two or more inductance controlling units 120.

The inductor unit 110 further includes a pair of input and output terminals 112 and 113 which are electrically connected to both ends of the coil pattern. The inductor unit 110 further includes a path forming unit 114 in order to prevent a short circuit between any one of the pair of input and output terminals 112 and 113 and the coil pattern 111.

Although FIG. 1 illustrates that the inductor unit includes the coil pattern having a spiral shape, the coil pattern may be implemented in various shapes such as a helical shape, or a meandering line shape.

The variable inductance inductor 100 varies the inductance value by adjusting a contact area between the coil pattern 111 and the conductor unit 121 to change a current path. That is, the inductance value of the inductor is greatly influenced by a length of the coil pattern. Thus, the variable inductance inductor 100 provides an effect similar to a case in which the length of the coil pattern is changed by changing the current path using the conductor unit, thereby varying the inductance value. For example, for a coil pattern having a spiral shape having four turns, when the coil pattern having two turns and the conductor unit are in contact with each other, an inductance value is similar to a case in which the coil pattern has a spiral shape of three turns.

The inductance controlling unit 120 further includes a support member 122 that supports the conductor unit 121 and is flexibly deformed according to an application of external driving force, to adjust the contact area between the coil pattern 111 and the conductor unit 121. A type of external driving force applied to the support member 122 and a means for applying the external driving force may be varied. For example, an actuator may drive the support member in a direction parallel to a coil surface to apply mechanical force, thereby flexibly deforming the support member.

However, as an example in which the flexible deformation of the support member 122 may be more easily implemented, the support member may be flexibly deformed by disposing a piezoelectric material 123 on at least one surface of the support member and using an inverse piezoelectric effect. The type of piezoelectric material may be varied. For example, the piezoelectric material may be lead zirconate titanate (PZT).

The piezoelectric material refers to a material in which mechanical deformation occurs when electricity is applied thereto. In a case in which electrodes having opposing polarities are disposed on upper and lower portions of the piezoelectric material and electricity is applied thereto, contraction or expansion of the piezoelectric material occurs by the inverse piezoelectric effect. Using this principle, when a voltage is applied to first and second electrodes 124 and 125 disposed on the upper and lower portions of the piezoelectric material 123, the piezoelectric material 123 disposed on the support member 122 is deformed thereby causing the support member 122 to curve in a dome shape or an arc shape at a predetermined angle. In this case, since a degree to which the support member 122 is curved is changed according to the applied voltage, the contact area between the coil pattern 111 and the conductor unit 121 is easily controlled by appropriately controlling the amount of voltage applied thereto.

Figure 4A:
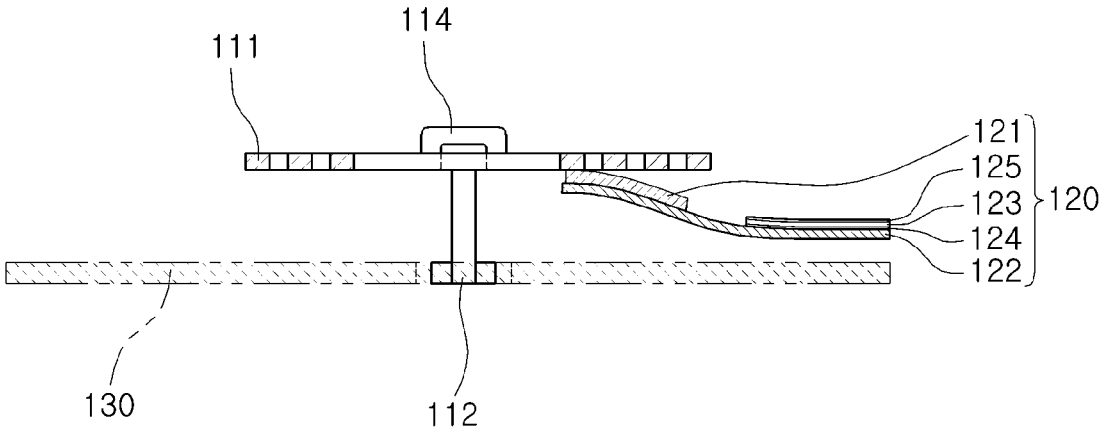
FIGS. 4A and 4B are diagrams illustrating a principle of varying inductance of a variable inductance inductor according to one or more embodiments.
Figure 4B:
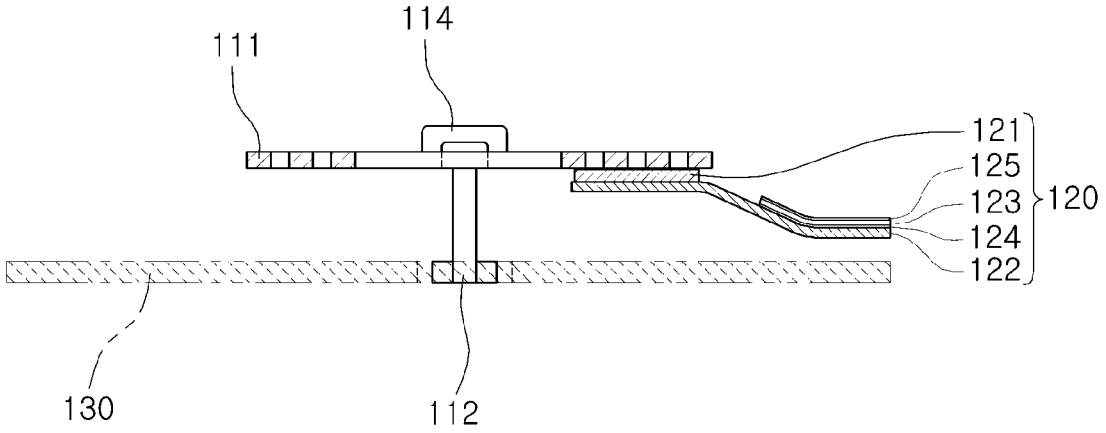

When the voltage is not applied to the first and second electrodes, the inductance controlling unit 120 configured as illustrated in FIG. 2. In this state, when a predetermined voltage is applied to the first and second electrodes, the support member 122 is curved in an arc shape at a predetermined angle as illustrated in FIG. 4A and a portion of the coil pattern 111 and the conductor unit 121 are in contact with each other. If strength of the applied voltage is increased, the contact area between the coil pattern 111 and the conductor unit 121 may be gradually increased, and consequently, an overall of the coil pattern 111 and the conductor unit 121 may be in contact with each other as illustrated in FIG. 4B.

Figure 5A:
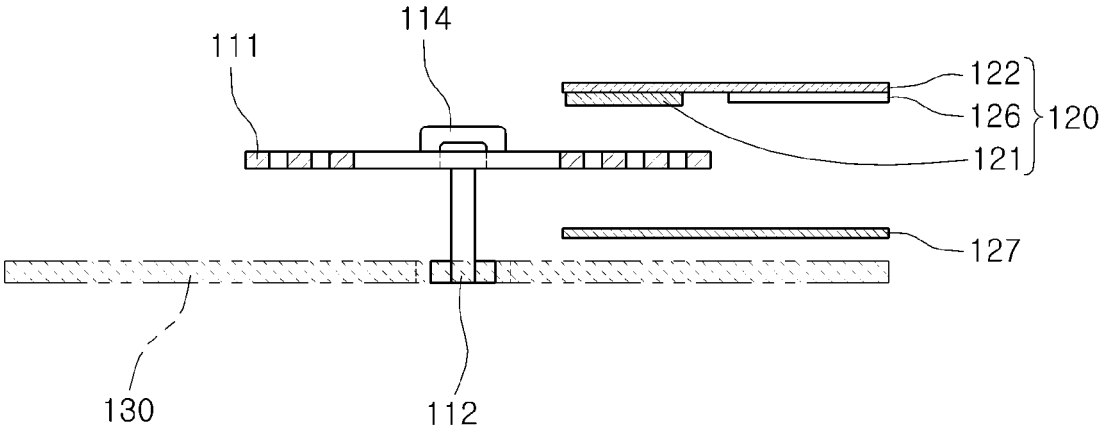
FIGS. 5A through 5C are diagrams illustrating a principle of varying inductance of a variable inductance inductor according to one or more embodiments.
Figure 5B:
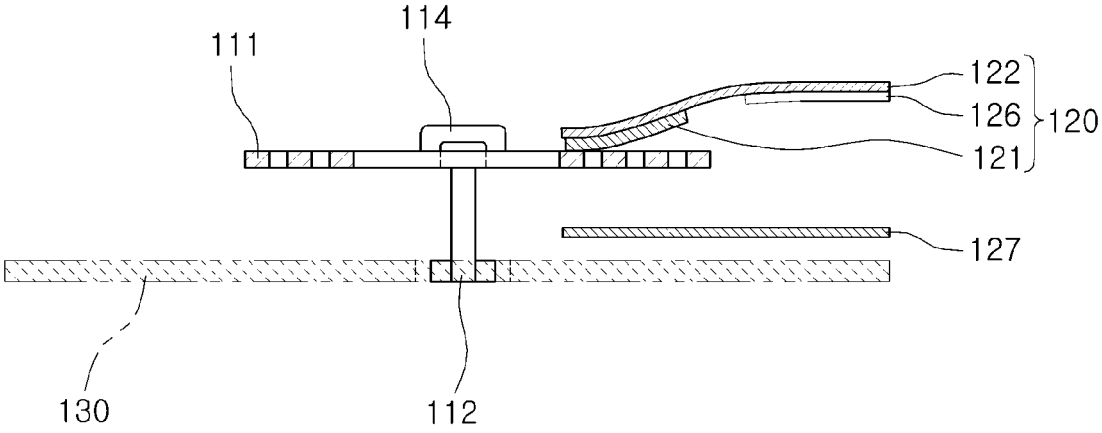
Figure 5C:
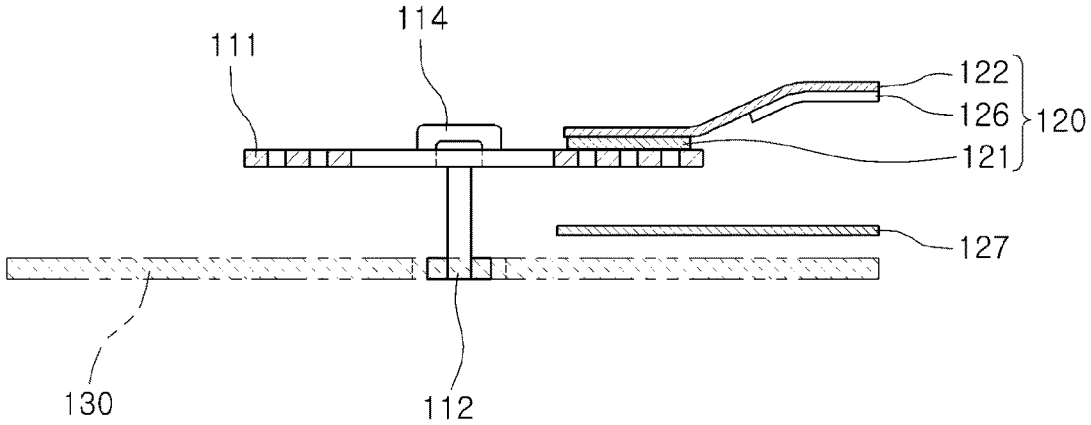

Referring to FIGS. 5A through 5C, according to another embodiment, a signal electrode 126 is formed on the support member, and a ground electrode 127 is spaced apart from the inductance controlling unit. If the ground electrode 127 is spaced apart from the inductance controlling unit, a position of the ground electrode 127 may be varied. However, the ground electrode is positioned to cause a flexible deformation of the support member 122 by electrostatic attraction with the signal electrode 126.

When the voltage is not applied to the signal electrode 126, the inductance controlling unit 120 is configured as illustrated in FIG. 5A. In this state, when a predetermined voltage is applied to the signal electrode 126, the support member 122 is curved in an arc shape at a predetermined angle by electrostatic attraction as illustrated in FIG. 5B and a portion of the coil pattern 111 contacts the conductor unit 121. If strength of the applied voltage is increased, the contact area between the coil pattern 111 and the conductor unit 121 is gradually increased, and consequently, the entire conductor unit 121 contacts the coil pattern 111 as illustrated in FIG. 5C.

Hereinafter, a variable inductance inductor module according to another aspect will be described in detail. The variable inductance inductor module according to another embodiment includes an insulating substrate 130, the inductor unit 110 including the coil pattern 111, the inductance controlling unit 120 including the conductor unit 121, and a driving unit (140, 141 in FIGS. 7A and 7B) varying an inductance value by applying external driving force to the inductance controlling unit and adjusting a contact area between the coil pattern and the conductor unit to change a current path.

The insulating substrate 130 serves to simply support the inductor unit 110 and a type thereof may be varied. For example, a ferromagnetic ceramic substrate including a material such as ferrite having a predetermined dielectric constant or a non-magnetic ceramic substrate may be used.

Figure 7A:
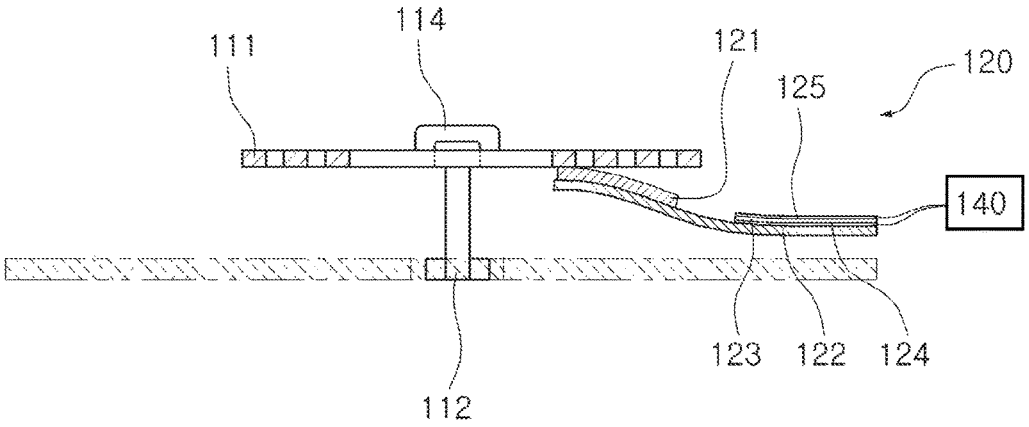
FIGS. 7A and 7B are diagrams illustrating examples of types of driving units.
Figure 7B:
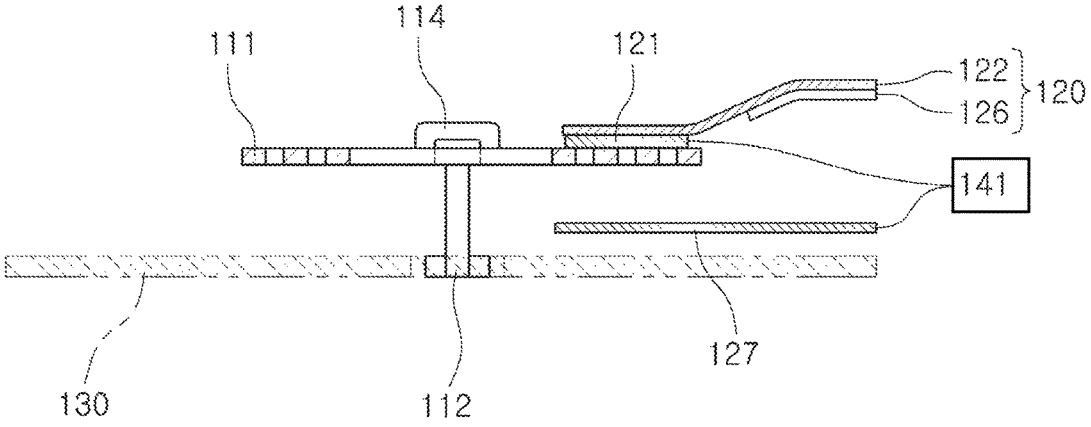

Referring to FIGS. 7A and 7B, a type of driving unit 140, 141 may be varied. For example, the driving unit 140, 141 may be a voltage application device that applies the voltage to the first and second electrodes 124 and 125 or the signal electrode 126.

Figure 6:
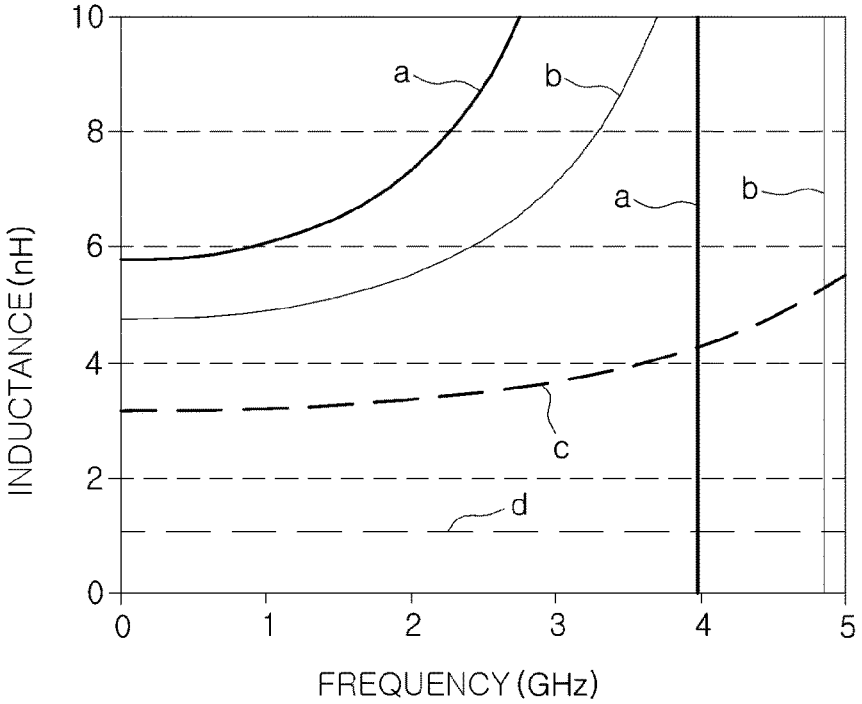
FIG. 6 is a graph illustrating variations in inductance of a variable inductance inductor according to one or more embodiments.

Referring to FIG. 6, the inductance of the variable inductance inductor according to one or more embodiment is varied according to the contact area between the coil pattern and the conductor unit. FIG. 6 is a graph illustrating an inductance change according to the contact area between the coil pattern and the conductor unit, for a variable inductance inductor having a coil pattern of a spiral shape of four turns, where line 'a' corresponds to a case in which the coil pattern and the conductor unit are not in contact with each other. Line 'b' corresponds to a case in which the conductor contacts a coil pattern of two turns. Line 'c' corresponds to a case in which the conductor unit contacts a coil pattern of three turns.

Line 'd' corresponds to a result obtained by measuring the inductance value according to a frequency of a case in which the coil pattern of four turns and the conductor unit are in contact with each other. Referring to FIG. 6, as the contact area between the coil pattern and the conductor unit is increased, the inductance value is decreased.

As set forth above, according to the exemplary embodiments in the present disclosure, the variable inductance inductor may easily vary the inductance and may easily miniaturize a product.

As a non-exhaustive example only, a device as described herein may be a mobile device, such as a cellular phone, a smart phone, a wearable smart device (such as a ring, a watch, a pair of glasses, a bracelet, an ankle bracelet, a belt, a necklace, an earring, a headband, a helmet, or a device embedded in clothing), a portable personal computer (PC) (such as a laptop, a notebook, a subnotebook, a netbook, or an ultra-mobile PC (UMPC), a tablet PC (tablet), a phablet, a personal digital assistant (PDA), a digital camera, a portable game console, an MP3 player, a portable/personal multimedia player (PMP), a handheld e-book, a global positioning system (GPS) navigation device, or a sensor, or a stationary device, such as a desktop PC, a high-definition television (HDTV), a DVD player, a Blu-ray player, a set-top box, or a home appliance, or any other mobile or stationary device capable of wireless or network communication. In one example, a wearable device is a device that is designed to be mountable directly on the body of the user, such as a pair of glasses or a bracelet. In another example, a wearable device is any device that is mounted on the body of the user using an attaching device, such as a smart phone or a tablet attached to the arm of a user using an armband, or hung around the neck of the user using a lanyard.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A variable inductance inductor comprising:
an inductor unit comprising a coil pattern;
a support member;
a conductor unit disposed on a first end portion of the support member;
a piezoelectric material disposed on a second end portion of the support member;
a first electrode disposed on an upper portion of the piezoelectric material; and
a second electrode disposed on a lower portion of the piezoelectric material,
wherein, the piezoelectric material is configured to bend the support member to vary a contact area between the coil pattern and the conductor unit in response to the first electrode polarity being opposed to the second polarity, to change a current path in the coil pattern.

2. The variable inductance inductor of claim 1, wherein the support member is configured to be flexibly deformed according to an application of driving force to adjust the contact area between the coil pattern and the conductor unit.

3. The variable inductance inductor of claim 1,
wherein the piezoelectric material is further disposed between the first and second electrodes.

4. The variable inductance inductor of claim 1, wherein the piezoelectric material is lead zirconate titanate.

5. The variable inductance inductor of claim 1, wherein the piezoelectric material is configured to deform the support member into a curve in a predetermined direction when an external voltage is applied thereto, and adjust the contact area between the coil pattern and the conductor unit.

6. The variable inductance inductor of claim 1, further comprising:
a signal electrode disposed on the support member; and
a ground electrode spaced apart from the inductance controlling unit.

7. The variable inductance inductor of claim 6, wherein the signal electrode is configured to deform the support member to be curved in a predetermined direction by electrostatic attraction when external voltage is applied thereto and adjust the contact area between the coil pattern and the conductor unit.

8. The variable inductance inductor of claim 1, wherein the inductor unit further comprises a pair of input and output terminals electrically connected to both ends of the coil pattern.

9. The variable inductance inductor of claim 8, wherein the inductor unit further comprises a path forming unit configured to prevent a short circuit between any one of the pair of input and output terminals and the coil pattern.

10. The variable inductance inductor of claim 1, wherein an inductance value varies according to the contact area.

11. A variable inductance inductor module comprising:

an insulating module;

an inductor unit comprising a coil pattern;

an inductor unit comprising a coil pattern;

a support member;

a conductor unit disposed on a first end portion of the support member;

a piezoelectric material disposed on a second end portion of the support member;

a first electrode disposed on an upper portion of the piezoelectric material;

a second electrode disposed on a lower portion of the piezoelectric material; and wherein, the piezoelectric material is configured to bend the support member to vary a contact area between the coil pattern and the conductor unit in response to the first electrode polarity being opposed to the second polarity, to change a current path in the coil pattern.

12. The variable inductance inductor module of claim 11, wherein the support member is configured to be flexibly deformed according to an application of driving force to adjust the contact area between the coil pattern and the conductor unit.

13. The variable inductance inductor module of claim 11, wherein the piezoelectric material is further disposed between the first and second electrodes.

14. The variable inductance inductor module of claim 11, wherein the piezoelectric material is configured to deform the support member into a curve in a predetermined direction when external voltage is applied thereto, and adjust the contact area between the coil pattern and the conductor unit.

15. The variable inductance inductor module of claim 12, further comprising:

a signal electrode disposed on the support member; and a ground electrode spaced apart from the inductance controlling unit.

16. The variable inductance inductor of claim 1, wherein the conductor unit is spaced apart from the coil pattern in response to the first electrode polarity being the same as the second electrode polarity.

17. The variable inductance inductor module of claim 11, wherein the conductor unit is spaced apart from the coil pattern in response to the first electrode polarity being the same as the second electrode polarity.

* * * * *